US009055628B2

(12) United States Patent
Wu et al.

(10) Patent No.: US 9,055,628 B2
(45) Date of Patent: Jun. 9, 2015

(54) ILLUMINATION SYSTEM AND OPERATION METHOD THEREOF

(75) Inventors: Wen-Chi Wu, Hsin-Chu (TW); Chih-Hua Lin, Hsin-Chu (TW)

(73) Assignee: Young Lighting Technology Inc., Hsin-Chu (TW)

( * ) Notice: Subject to any disclaimer, the term of this patent is extended or adjusted under 35 U.S.C. 154(b) by 785 days.

(21) Appl. No.: 13/345,741

(22) Filed: Jan. 8, 2012

(65) Prior Publication Data

US 2012/0235573 A1 Sep. 20, 2012

(30) Foreign Application Priority Data

Mar. 16, 2011 (TW) ..... 100108938 A

(51) Int. Cl.

| | |
|---|---|
| ***H01J 1/60*** | (2006.01) |
| ***H01J 7/42*** | (2006.01) |
| ***H05B 37/04*** | (2006.01) |
| ***H05B 37/02*** | (2006.01) |
| ***F21V 23/04*** | (2006.01) |
| ***H05B 39/08*** | (2006.01) |

(52) U.S. Cl.

CPC ..... *H05B 37/0272* (2013.01); *F21V 23/045* (2013.01); *H05B 39/088* (2013.01)

(58) Field of Classification Search

None

See application file for complete search history.

(56) References Cited

U.S. PATENT DOCUMENTS

| | | | | |
|---|---|---|---|---|
| 5,838,226 | A * | 11/1998 | Hougy et al. | 340/12.32 |
| 7,633,406 | B2 | 12/2009 | Miki | |
| 2006/0158344 | A1* | 7/2006 | Bambini et al. | 340/825.69 |
| 2012/0105195 | A1* | 5/2012 | Schultz | 340/5.61 |
| 2012/0181935 | A1* | 7/2012 | Velazquez | 315/132 |

FOREIGN PATENT DOCUMENTS

| | | |
|---|---|---|
| TW | 595261 | 6/2004 |
| TW | M304182 | 1/2007 |
| TW | 200826734 | 6/2008 |
| TW | I299240 | 7/2008 |
| TW | M359894 | 6/2009 |
| WO | 2010097400 | 9/2010 |

OTHER PUBLICATIONS

"Office Action of Taiwan Counterpart Application", issued on Jan. 21, 2014, p. 1-p. 9.

* cited by examiner

*Primary Examiner* — Anh Tran

(74) *Attorney, Agent, or Firm* — Jianq Chyun IP Office

(57) ABSTRACT

An illumination system and an operation method thereof are provided. The illumination system includes a first controller and a first lighting device. The first controller is capable of emitting a wireless control signal. The first lighting device is capable of receiving the wireless control signal, adjusting a light emitting state thereof according to the wireless control signal, and accordingly emitting a wireless feedback signal. When the first controller does not receive the wireless feedback signal within a predetermined time or receives a wrong wireless feedback signal after the first controller emitted the wireless control signal to the first lighting device, the first controller emits the wireless control signal again.

27 Claims, 8 Drawing Sheets

ILLUMINATION SYSTEM AND OPERATION METHOD THEREOF

CROSS-REFERENCE TO RELATED APPLICATION

This application claims the priority benefit of Taiwan application serial no. 100108938, filed on Mar. 16, 2011. The entirety of the above-mentioned patent application is hereby incorporated by reference herein and made a part of this specification.

BACKGROUND OF THE INVENTION

1. Field of the Invention

The invention relates generally to an illumination system and an operation method thereof. More specifically, the invention relates to an illumination system having a wireless control function and an operation method thereof.

2. Description of Related Art

For conventional lighting device using light bulbs as the light source, since the lighting device is typically controlled by switch controllers embedded in the wall, the lighting device can only be controlled to turn on or off. Moreover, because the switch controller is directly connected to the lighting device, the switch controller is disposed within a visible range of the lighting device. When a user operates the switch controller, the user can directly observe the current on or off state of the lighting device.

After the brightness level of the light emitting diode (LED) had been drastically improved, LEDs have been used as the light source in some lighting device commonly referred to as LED lighting device. Since the LED can be driven more easily than the light bulb, and the brightness level of the LED can be easily adjusted by the magnitude of the voltage or current, therefore for the LED lighting device, not only the on/off states of the LED lighting device can be controlled, but the brightness level thereof can also be adjusted.

If the controller and the lighting device are connected directly by a circuit, then the controller is disposed within a visible range of the lamp, such that while the controller is operated, the state of the lamp can be observed currently. Although the controller connected by circuitry to the lighting device can accurately control the state of the lighting device, it is not inconvenience in usage that the applicable use of the lighting device must accommodate the location of the controller because the controller and the lighting device are both fixed. Moreover, though current wireless lighting device controllers provide convenient operation, most controllers provide only a one-way control of the lighting device, without the ability to accurately control the brightness level of the lighting device according to the state of the lighting device.

Taiwan Patent No. M359894 disclosed a brightness adjusting device with a feedback function, in which a controller drives a lighting device through a brightness adjuster, and the brightness adjuster transmits the current brightness of the lighting device to the controller. WIPO Patent Publication No. WO2010097400 disclosed a control system for controlling the sources of one or a plurality of controllable devices and a method of enabling the control system. The controllable devices respectively have different identification codes. A display of a control device displays the corresponding control selections of the controllable devices, and the user controls the corresponding controllable device through the control selections. U.S. Pat. No. 7,633,406 disclosed an illumination control system, in which a local device compares the light intensity of a light source of each lighting device and generates a comparison result. Moreover, the comparison result is transmitted to each lighting device according to the corresponding identification code of each lighting device. The brightness of the light source of each lighting device is adjusted to a predetermined light intensity according to the received comparison result.

SUMMARY OF THE INVENTION

Accordingly, the invention is directed to an illumination system and an operation method of the illumination system, in which a controller of the illumination system may display information of each lighting device. Moreover, when a wireless feedback signal is not received, or a wrong wireless feedback signal is received, a wireless control signal may be emitted again to ensure the lighting device is adjusted according to user control, and the controller properly displays the accurate lighting device information.

Other objects and advantages of the invention can be further illustrated by the technical features broadly embodied and described as follows.

In order to achieve one or a portion of or all of the objects or other objects, one embodiment of the invention is directed to an illumination system including a first controller and a first lighting device. The first controller is configured to emit a first wireless control signal. The first lighting device is configured to receive the first wireless control signal, adjust a first light emitting state thereof according to the first wireless control signal, and accordingly emit a first wireless feedback signal. The first controller emits the first wireless control signal to the first lighting device again when the first wireless feedback signal is not received within a predetermined time, or when a wrong wireless feedback signal is received after the first controller emits the first wireless control signal to the first lighting device. The first controller may display a lighting device information of the first lighting device according to the received first wireless feedback signal.

In order to achieve one or a portion of or all of the objects or other objects, one embodiment of the invention is directed to an operation method of an illumination system, in which the illumination system includes a first controller and a first lighting device, and the operation method of the illumination system includes the following steps. The first controller emits a first wireless control signal to the first lighting device. The first lighting device receives the first wireless control signal, adjusts a light emitting state thereof according to the first wireless control signal, and accordingly emits a first wireless feedback signal to the first controller. When the first controller has not received the first wireless feedback signal within a predetermined time, or has received a wrong wireless feedback signal, the first controller emits the wireless control signal to the first lighting device again. When the first controller receives the first wireless feedback signal, the first controller displays a lighting device information of the first lighting device according to the received first wireless feedback signal.

According to embodiments of the invention, after the first controller emits the wireless control signal to the first lighting device, the same wireless control signal can be emitted again when the corresponding wireless feedback signal is not received within a predetermined time, or when a wrong feedback signal is received. Thereby, the first lighting device can be properly adjusted according to the wireless control signal, and the first controller can accurately display the lighting device information of the first lighting device.

Other objectives, features and advantages of the invention will be further understood from the further technological features disclosed by the embodiments of the invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

Figure 1A:
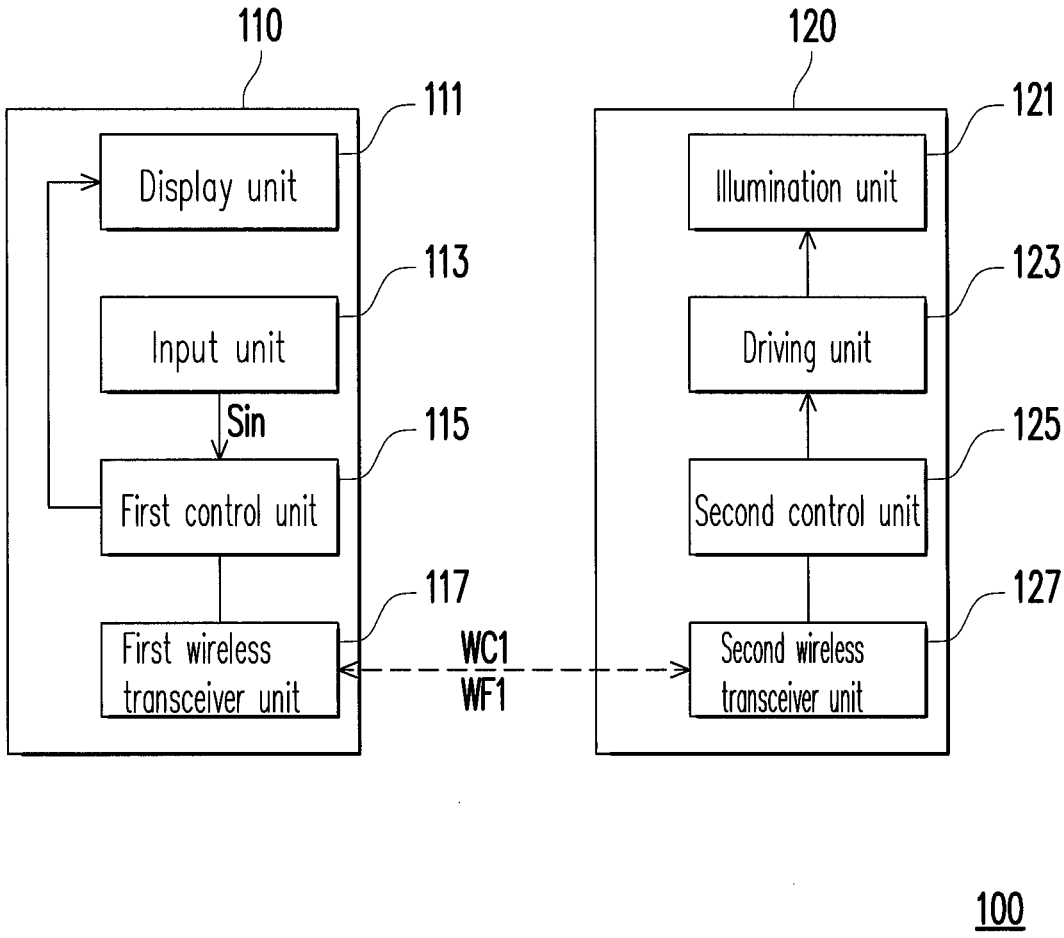
FIG. 1A is a schematic diagram of an illumination system according to a first embodiment of the invention.

FIG. 1A is a schematic diagram of an illumination system according to a first embodiment of the invention. Referring to FIG. 1A, in the present embodiment, an illumination system 100 includes a first controller 110 and a first lighting device 120. The first controller 110 may emit a wireless control signal WC1 to the first lighting device 120 for adjusting a light emitting state (e.g., luminance, illuminating color tone, or illuminating operating mode) of the first lighting device 120. After the first lighting device 120 receives the wireless control signal WC1, the first lighting device 120 may adjust the light emitting state thereof according to the wireless control signal WC1, and accordingly emit a wireless feedback signal WF1. Moreover, the wireless control signal WC1 and the wireless feedback signal WF1 may be infrared signals or radio frequency signals configurable for people of ordinary skill in the art.

Typically speaking, the first controller 110 receives the wireless feedback signal WF1 within a predetermined time (e.g. 5 seconds) after emitting the wireless control signal WC1. The first controller 110 may display a lighting device information (e.g., identification code, luminance, illuminating color tone, or illuminating operating mode of the first lighting device 120) of the first lighting device 120 according to the received wireless feedback signal WF1 of the first lighting device 120. When a distance between the first controller 110 and the first lighting device 120 is too large or too many obstacles lie therebetween, the first lighting device 120 may not receive the wireless control signal WC1, or the signal intensity of the received wireless control signal WC1 is too weak for accurate decoding. Therefore, the first lighting device 120 cannot be adjusted according to the wireless control signal WC1, and the wireless feedback signal cannot be correspondingly emitted. Moreover, the wireless feedback signal WF1 emitted by the first lighting device 120 according to the wireless control signal WC1 may also be affected when the distance between the first controller 110 and the first lighting device 120 is too large or too many obstacles lie therebetween. That is to say, the first controller 110 may not receive the wireless feedback signal WF1, or the wireless feedback signal WF1 received cannot be accurately decoded (i.e., a wrong wireless feedback signal). An inaccurate decode may be, for example, a mismatch between a decoded information and an anticipated information, or an insufficient amount of decoded bits.

Therefore, proper signal transmission between the first controller 110 and the first lighting device 120 is assured by a handshaking process. The first controller 110 includes a display unit 111, an input unit 113, a first control unit 115, and a first wireless transceiver unit 117. The display unit 111 includes at least one display device (e.g. a liquid crystal display (LCD) panel), and the display unit 111 is controlled by the first control unit 115 to display the lighting device information of the first lighting device 120. The input unit 113 includes at least one input device (e.g., a switch, a keypad, or a touch module) to provide a user interface and to output an input signal Sin. The first wireless transceiver unit 117 is for emitting the wireless control signal WC1 and receiving the wireless feedback signal WF1. The first control unit 115 is coupled to the display unit 111, the input unit 113, and the first wireless transceiver unit 117. Moreover, the first control unit 115 controls the first wireless transceiver unit 117 to emit the wireless control signal WC1 according to the input signal Sin, and the first control unit 115 controls the display unit 111 to display the lighting device information of the first lighting device 120 according to the wireless feedback signal WF1.

The first control unit 115 may emit the same wireless control signal WC1 again through the first wireless transceiver unit 117 when the wireless feedback signal WF1 is not received within a predetermined time, or when a wrong wireless feedback signal WF1 is received after the first control unit 115 controls the first wireless transceiver unit 117 to emit the wireless control signal WC1. In other embodiments, when the first control unit 115 controls the first wireless transceiver unit 117 to emit the same wireless control signal WC1 a predetermined number of times (e.g. 5 times), and the wireless feedback signal WF1 from the first lighting device 120 is not received or the wrong wireless feedback signal WF1 is received, the first control unit 115 controls the display unit 111 to display an error message in order to notify the user that an accurate connection cannot be established between the first control unit 115 and the first lighting device 120.

The first lighting device 120 includes an illumination unit 121, a driving unit 123, a second controller unit 125, and a second wireless transceiver unit 127. The illumination unit 121 includes at least one light emitting device (e.g., an LED or a light bulb) to provide illumination. The driving unit 123 is coupled to the illumination unit 121 for driving the illumination unit 121. The driving unit 123 is, for example, a driver for the light emitting device, such as an LED driver or a lamp driver. The second wireless transceiver unit 127 is for receiving the wireless control signal WC1 and is controlled by the second control unit 125 to emit the wireless feedback signal WF1. The second control unit 125 is coupled to the driving unit 123 and the second wireless transceiver unit 127. Moreover, according to the wireless control signal WC1, the second control unit 125 adjusts the luminance, illuminating color tone, or the illuminating operating mode of the illumination unit 121 through the driving unit 123, and emits the wireless feedback signal WF1 through the second wireless transceiver unit 127.

In the present embodiment, the wireless control signal WC1 may include a controller identification code, a target lighting device identification code, and a control operation code. The controller identification code is for identifying which controller emitted the wireless control signal WC1 by the first lighting device 120. The target lighting device identification code is the identification code corresponding to the lighting device (e.g. first lighting device 120) that the wireless control signal WC1 transmit to. The control operation code is the code corresponding to a control operation (e.g. an increase luminance or a decrease luminance control operation) decided by the user for adjusting the lighting device 120. In the present embodiment, the wireless feedback signal WF1 includes the control operation code and the lighting device information. In other embodiments, the wireless feedback signal WF1 includes a first identification code, a second identification code, the control operation code, and the lighting device information. Moreover, the first identification code is the identification code corresponds to the controller that the wireless feedback signal WF1 is transmitting to, and the second identification code is the identification code corresponds to the controller emitting the wireless control signal WC1. When the wireless control signal WC1 is emitted by the first controller 110, and the wireless feedback signal WF1 is emitted to the same first controller 110, the first and second identification codes of the wireless feedback signal WF1 correspond to the same identification code of the first controller. However, in other embodiments where other controllers are configured, the first identification codes of different wireless feedback signals may correspond to the identification code of a destination controller. When the illumination unit 121 is formed by a light bulb or a plurality of same color LEDs, the lighting device information may include a lighting device identification code and a luminance. When the illumination unit 121 is formed by a plurality of different color LEDs, the lighting device information may include the lighting device identification code, the luminance, and the illuminating color tone. Besides the lighting device identification code, the luminance, and the illuminating color code, the lighting device information may further include an illuminating operating mode (e.g. an energy saving mode or a normal mode).

Figure 1B:
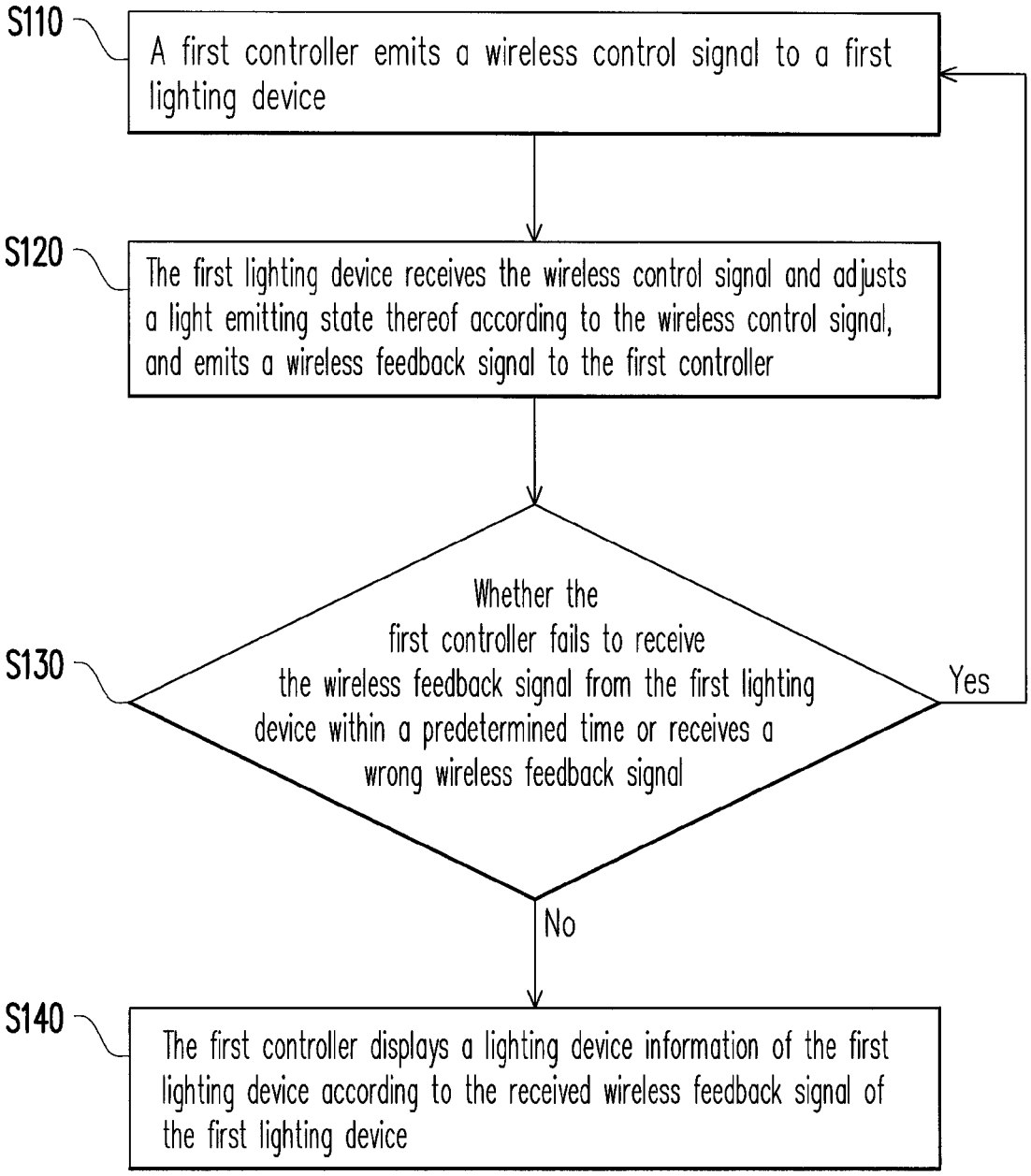
FIG. 1B is a flowchart of an operation method of the illumination system according to the first embodiment of the invention.

FIG. 1B is a flowchart of an operation method of the illumination system according to the first embodiment of the invention. Referring to FIG. 1B, in the present embodiment, a first controller emits a wireless control signal to a first lighting device (Step S110). The first lighting device receives the wireless control signal and adjusts a light emitting state thereof according to the wireless control signal, and accordingly emits a wireless feedback signal to the first controller (Step S120). When the wireless feedback signal from the first lighting device is not received within a predetermined time or a wrong wireless feedback signal is received with the first controller, then the result of Step S130 is determined as "yes", and the process returns to Step S110 so the first controller emits the wireless control signal to the first lighting device again. When the wireless feedback signal from the first lighting device is received within the predetermined time with the first controller, then the result of Step S130 is determined as "no", and the first controller displays a lighting device information of the first lighting device according to the received wireless feedback signal of the first lighting device (Step S140). Other steps in the operation method of the illumination system may refer to the description of the illumination system 100 provided above, and therefore further elaboration is omitted. Furthermore, the order of the aforementioned steps is merely for illustrative purposes, and thus the embodiments of the invention are not limited thereto.

Figure 2A:
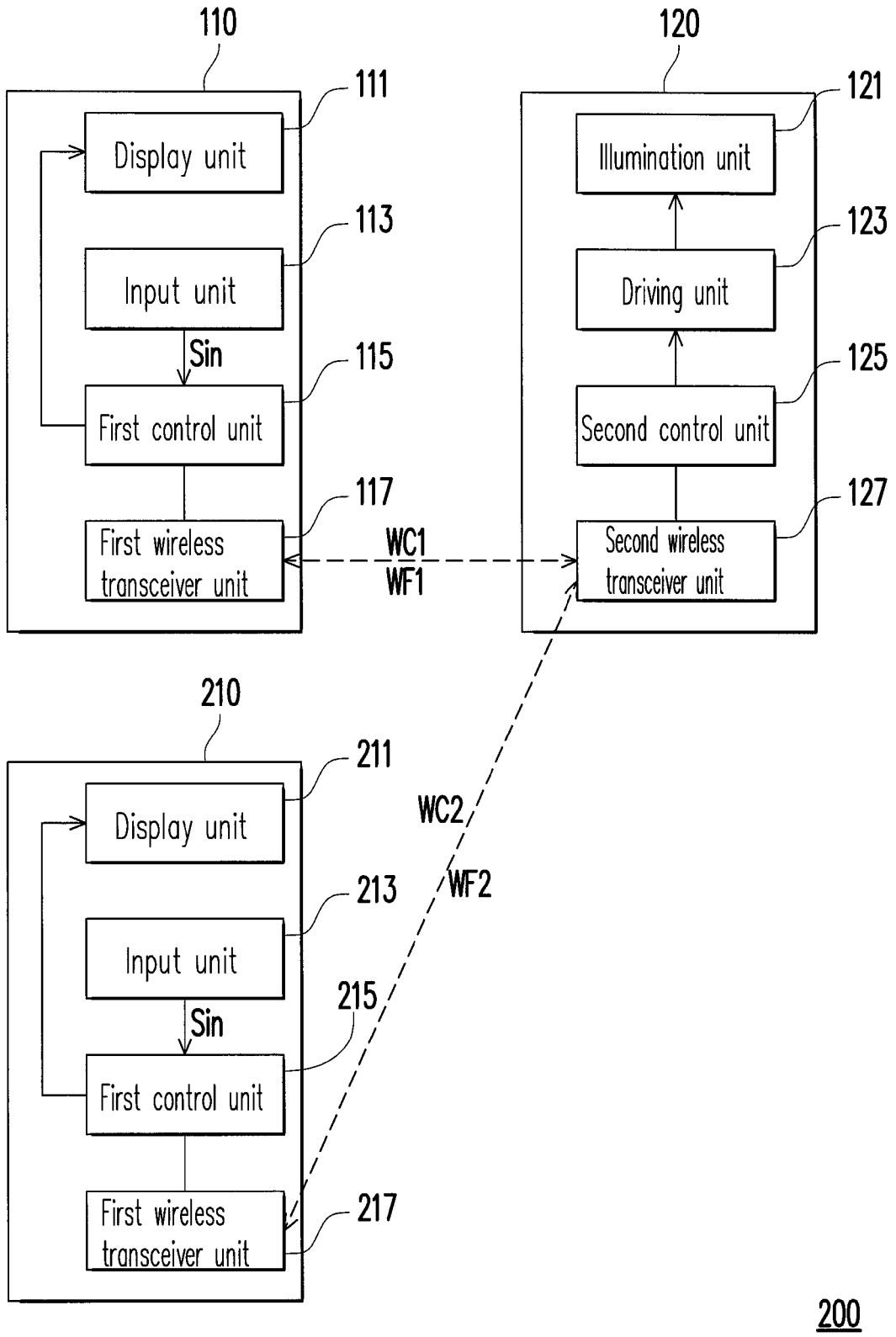
FIG. 2A is a schematic diagram of an illumination system according to a second embodiment of the invention.

FIG. 2A is a schematic diagram of an illumination system according to a second embodiment of the invention. Referring to FIGS. 1A and 2A, in the present embodiment, an illumination system 200 further includes a second controller 210, in which the circuit structure of the second controller 210 is similar to the first controller 110. That is to say, the operation of a display unit 211 is similar to the display unit 111, the operation of an input unit 213 is similar to the input unit 113, the operation of a first control unit 215 is similar to the first control unit 115, and the operation of a first wireless transceiver unit 217 is similar to the first wireless transceiver unit 117. Similarly, a wireless control signal WC2 emitted by the second controller 210 includes the corresponding controller identification code, target lighting device identification code, and control operation code.

In the present embodiment, the second control unit 125 of the first lighting device 120 may be configured in advance the quantity of controllers that control the first lighting device 120 and the content of the wireless feedback signal. Therefore, when the first lighting device 120 receives the wireless control signal WC1 of the first controller 110 and accordingly adjusts the light emitting state thereof, the first lighting device 120 emits different wireless feedback signals to the corresponding controllers according to the quantity of usable controllers. For example, the wireless feedback signals WF1 and WF2 may be emitted at the same time, in which the wireless feedback signal WF1 is emitted to the first controller 110, and the wireless feedback signal WF2 is emitted to the second controller 210. Moreover, both the first and second identification codes of the wireless feedback signal WF1 correspond to the identification code of the first controller 110, whereas the first and second identification codes of the wireless feedback signal WF2 respectively corresponds to the identification codes of the second controller 210 and the first controller 110. Therefore, when the second controller 210 receives the wireless feedback signal WF2, the lighting device information of the first lighting device 120 can be displayed according to the wireless feedback signal WF2. In addition, the first controller 110 and the second controller 210 can display which controller controls the first lighting device 120 and accordingly adjust the light emitting state of the first lighting device 120.

Moreover, when the first controller 110 and the second controller 210 respectively emits wireless control signals WC1 and WC2 to the first lighting device 120, the first lighting device 120 adjusts the light emitting state thereof according to the first one of the received wireless control signal. For example, when the first lighting device 120 first receives the wireless control signal WC1, the light emitting state thereof is adjusted according to the wireless control signal WC1, and the wireless feedback signals WF1 and WF2 are emitted thereafter. When the first lighting device 120 first receives the wireless control signal WC2, the light emitting state thereof is adjusted according to the wireless control signal WC2, and different wireless feedback signals are respectively emitted to the first controller 110 and the second controller 210 thereafter.

When both the first and second controllers 110 and 210 respectively receives the wireless feedback signals WF1 and WF2, since the first lighting device 120 is adjusted according to the wireless control signal (e.g., WC1 or WC2), therefore the first controller 110 and the second controller 210 can terminate emitting the same wireless control signal (e.g., WC1 or WC2) again. Conversely, when one of the first controller 110 and the second controller 210 has not received the corresponding wireless feedback signal (e.g., WF1 or WF2), then the controller which has not received the wireless feedback signal can emit the wireless control signal (e.g., WC1 or WC2) again. In the present embodiment, when the first controller 110 emits the wireless control signal WC1 to the first lighting device 120, the wireless feedback signal emitted by the first lighting device 120 to the second controller 210 according to the wireless control signal WC1 is different from the wireless feedback signal emitted by the first lighting device 120 to the second controller 210 according to the wireless control signal WC2, when the second controller 210 emits the wireless control signal WC2 to the first lighting device 120.

Figure 2B:
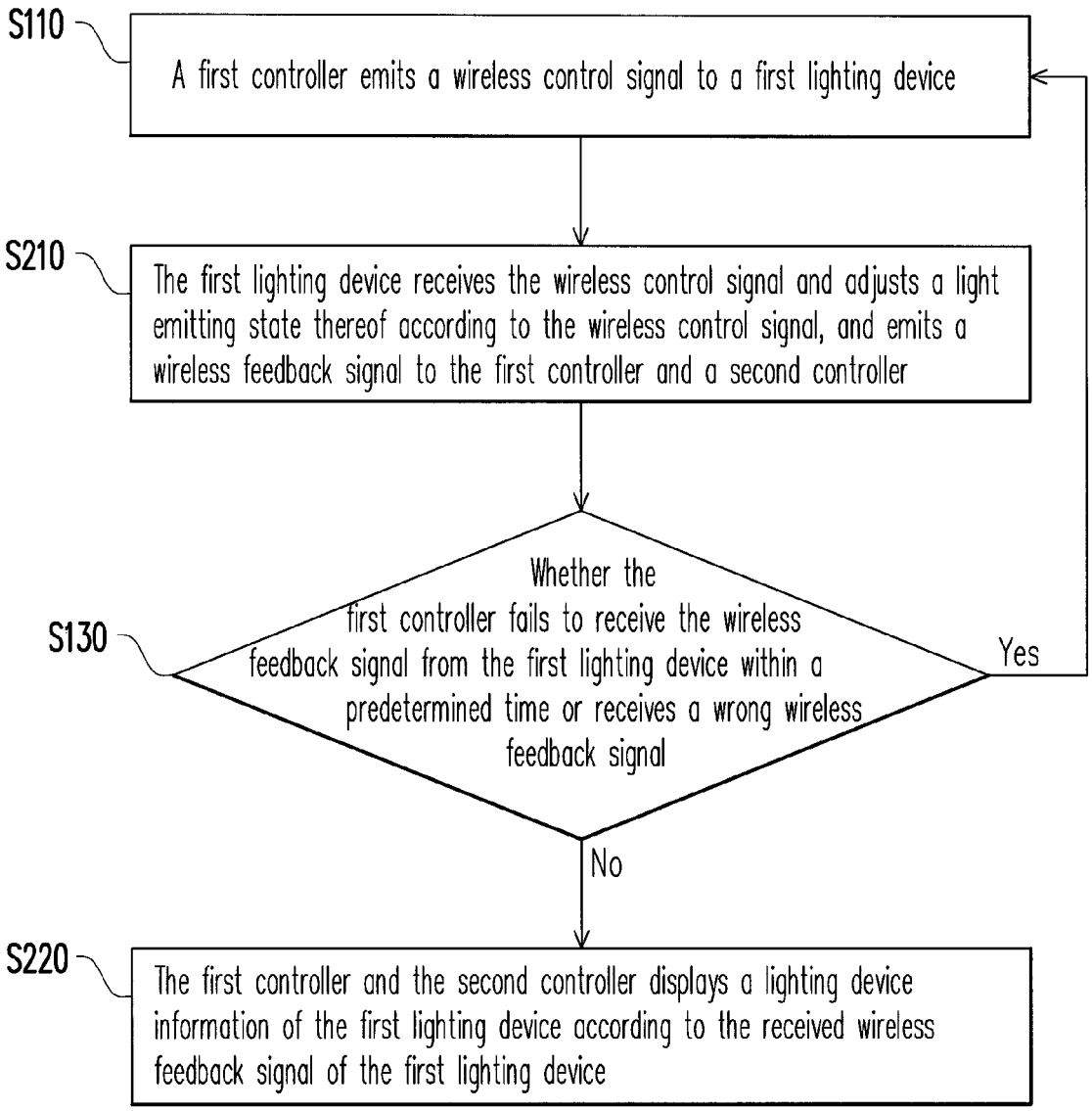
FIG. 2B is a flowchart of an operation method of the illumination system according to the second embodiment of the invention.

FIG. 2B is a flowchart of an operation method of the illumination system according to the second embodiment of the invention, and the operation method is exemplified by the first controller emitting the wireless control signal. Referring to FIGS. 1B and 2B, the differences therebetween are the Steps S210 and S220. In the Step S210, the first lighting device receives the wireless control signal and adjusts the light emitting state thereof according to the wireless control signal, and the first lighting device accordingly emits the wireless feedback signal to the first and second controllers. In the Step S220, the first and second controllers display the lighting device information of the first lighting device according to the received wireless feedback signal of the first lighting device. Other steps in the operation method of the illumination system may refer to the description of the illumination system 200 provided above, and therefore further elaboration is omitted. Furthermore, the order of the aforementioned steps is merely for illustrative purposes, and thus the embodiments of the invention are not limited thereto. Since the flowchart of the operation method of the second controller 210 emits the wireless control signal to control the first lighting device 120 and the first lighting device 120 emitting the wireless feedback signal to the first and second controllers 110 and 210 according the wireless control signal is similar to FIG. 2B, further elaboration is omitted.

Figure 3A:
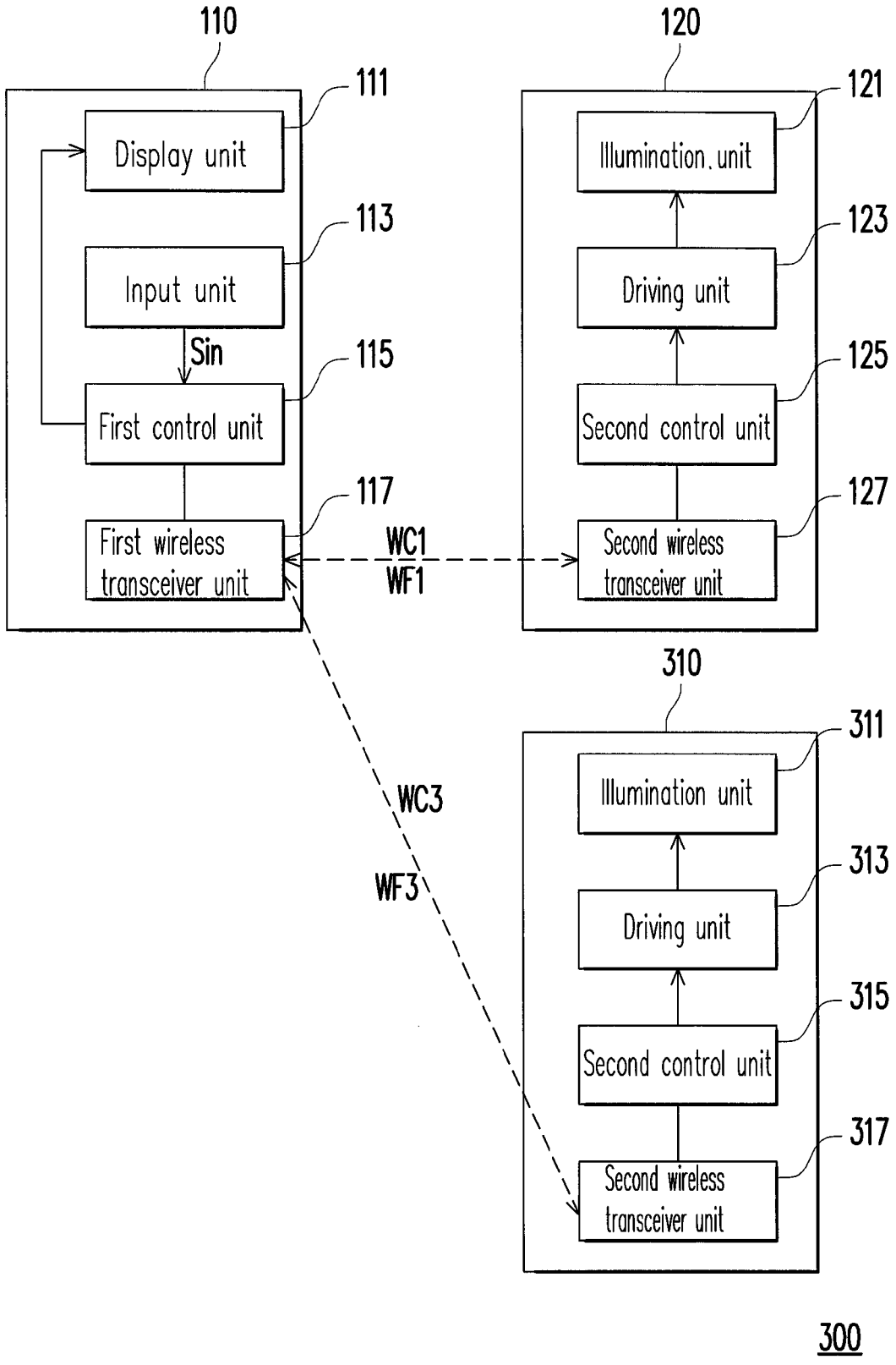
FIG. 3A is a schematic diagram of an illumination system according to a third embodiment of the invention.

FIG. 3A is a schematic diagram of an illumination system according to a third embodiment of the invention. Referring to FIGS. 1A and 3A, in the present embodiment, an illumination system 300 further includes a second lighting device 310, in which the circuit structure of the second lighting device 310 is similar to the first lighting device 120. That is to say, the operation of an illumination unit 311 is similar to the illumination unit 121, the operation of a driving unit 313 is similar to the driving unit 123, the operation of a second control unit 315 is similar to the second control unit 125, and the operation of a second wireless transceiver unit 317 is similar to the second wireless transceiver unit 127.

In the present embodiment, the first controller 110 may also emit a wireless control signal WC3 to the second lighting device 310. Moreover, when the first controller 110 has not received a wireless feedback signal WF3 from the second lighting device 310 within a predetermined time, or received a wrong wireless feedback signal WF3, the first controller 110 emits the same wireless control signal WC3 to the second lighting device 310 again. After receiving the accurate wireless feedback signal WF3, the first controller 110 displays the lighting device information of the second lighting device 310 according to the received wireless feedback signal WF3 of the second lighting device 310.

In other embodiments, when the first controller 110 emits the same wireless control signal WC3 a predetermined number of times (e.g. 5 times), and the wireless feedback signal WF3 from the second lighting device 310 is not received or the wrong wireless feedback signal WF3 is received, the first controller 110 may display an error message in order to notify the user that an accurate connection cannot be established between the first control unit 115 and the second lighting device 310.

Figure 3B:
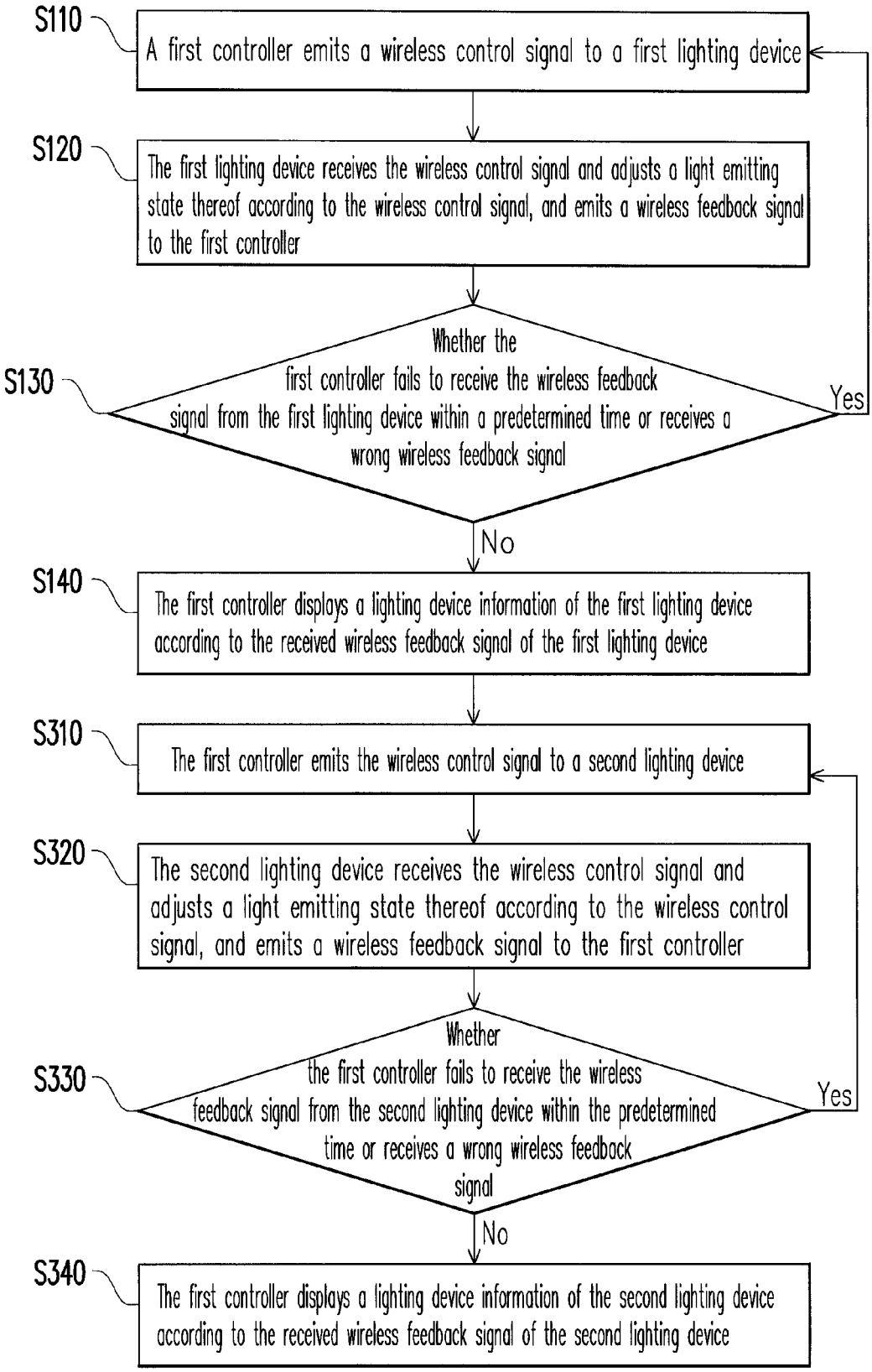
FIG. 3B is a flowchart of an operation method of the illumination system according to the third embodiment of the invention.

FIG. 3B is a flowchart of an operation method of the illumination system according to the third embodiment of the invention. Referring to FIGS. 1B and 3B, the differences therebetween are the Steps S310, S320, S330, and S340. In the Step S310, the first controller emits the wireless control signal to the second lighting device. In the Step S320, the second lighting device receives the wireless control signal, accordingly adjusts the light emitting state thereof, and emits the wireless feedback signal to the first controller. When the first controller has not received the wireless feedback signal from the second lighting device within a predetermined time, or has received a wrong wireless feedback signal, then the result of Step S330 is determined as "yes", and the process returns to Step S310 so the first controller emits the wireless control signal to the second lighting device again. When the first controller receives the wireless feedback signal from the second lighting device within the predetermined time, then the result of Step S330 is determined as "no", and the first controller displays the lighting device information of the second lighting device according to the received wireless feedback signal of the second lighting device (Step S340). Other steps in the operation method of the illumination system may refer to the description of the illumination system 300 provided above, and therefore further elaboration is omitted. Furthermore, the order of the aforementioned steps is merely for illustrative purposes, and thus the embodiments of the invention are not limited thereto. Since the wireless control signal may include the target lighting device identification code, therefore, according to an operation method of the present embodiment, the wireless control signal emitted by the first controller to the first lighting device is different from the wireless control signal emitted by the first controller to the second lighting device.

Figure 4A:
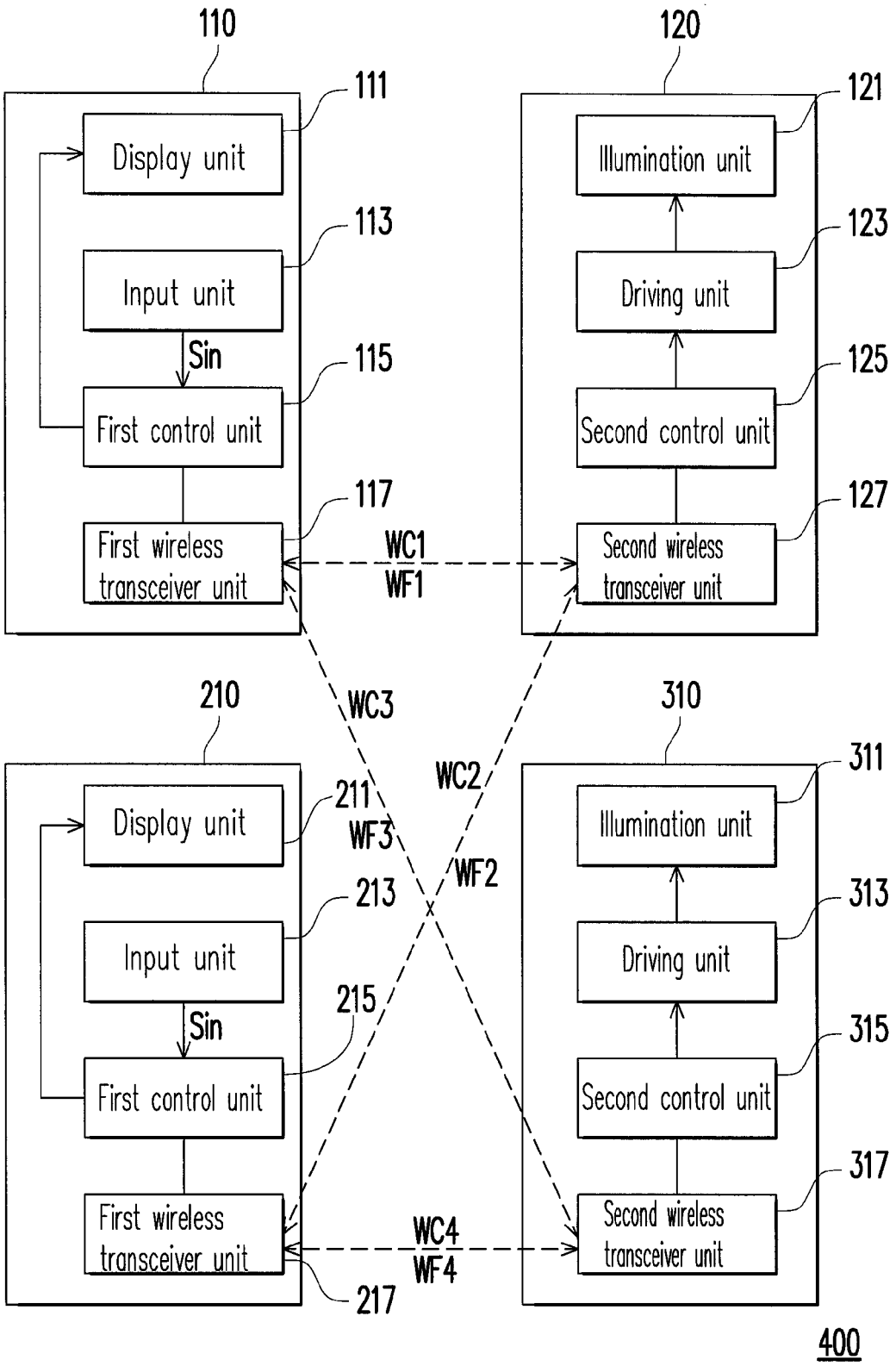
FIG. 4A is a schematic diagram of an illumination system according to a fourth embodiment of the invention.

FIG. 4A is a schematic diagram of an illumination system according to a fourth embodiment of the invention. Referring to FIGS. 1A-4A, in the present embodiment, an illumination system 400 includes the first controller 110, the first lighting device 120, the second controller 210, and the second lighting device 310, in which the first controller 110, the first lighting device 120, the second controller 210, and the second lighting device 310 may refer respectively to the corresponding description of the illumination systems 100, 200, and 300.

In the present embodiment, the second control unit 125 of the first lighting device 120 may be configured in advance the quantity of controllers that control the first lighting device 120 and the content of the wireless feedback signal of the first lighting device 120. Moreover, the second control unit 125 of the second lighting device 310 may be configured in advance the quantity of controllers that control the second lighting device 310 and the content of the wireless feedback signal of the second lighting device 310. The first controller 110 may emit the wireless control signal WC1 and the wireless control signal WC3 to the first and second lighting devices 120 and 310. The second controller 210 may emit the wireless control signal WC2 and the wireless control signal WC4 to the first and second lighting devices 120 and 310. Moreover, the first lighting device 120 may emit the wireless feedback signal WF1 and the wireless feedback signal WF2 to the first and second controllers 110 and 210. The second lighting device 310 may emit the wireless feedback signal WF3 and the wireless feedback signal WF4 to the first and second controllers 110 and 210. The operation of the first controller 110, the first lighting device 120, the second controller 210, and the second lighting device 310 is similar to the detailed description above, and thus further elaboration is omitted. In the present embodiment, when the first controller 110 emits the wireless control signal WC1 to the first lighting device 120, the wireless feedback signal emitted by the first lighting device 120 to the second controller 210 according to the wireless control signal WC1 is different from the wireless feedback signal emitted by the first lighting device 120 to the second controller 210 according to the wireless control signal WC2, when the second controller 210 emits the wireless control signal WC2 to the first lighting device 120. Similarly, when the second controller 210 emits the wireless control signal WC4 to the second lighting device 310, the wireless feedback signal emitted by the second lighting device 310 to the first controller 110 according to the wireless control signal WC4 is different from the wireless feedback signal emitted by the second lighting device 310 to the first controller 110 according to the wireless control signal WC3, when the first controller 120 emits the wireless control signal WC3 to the second lighting device 310.

Figure 4B:
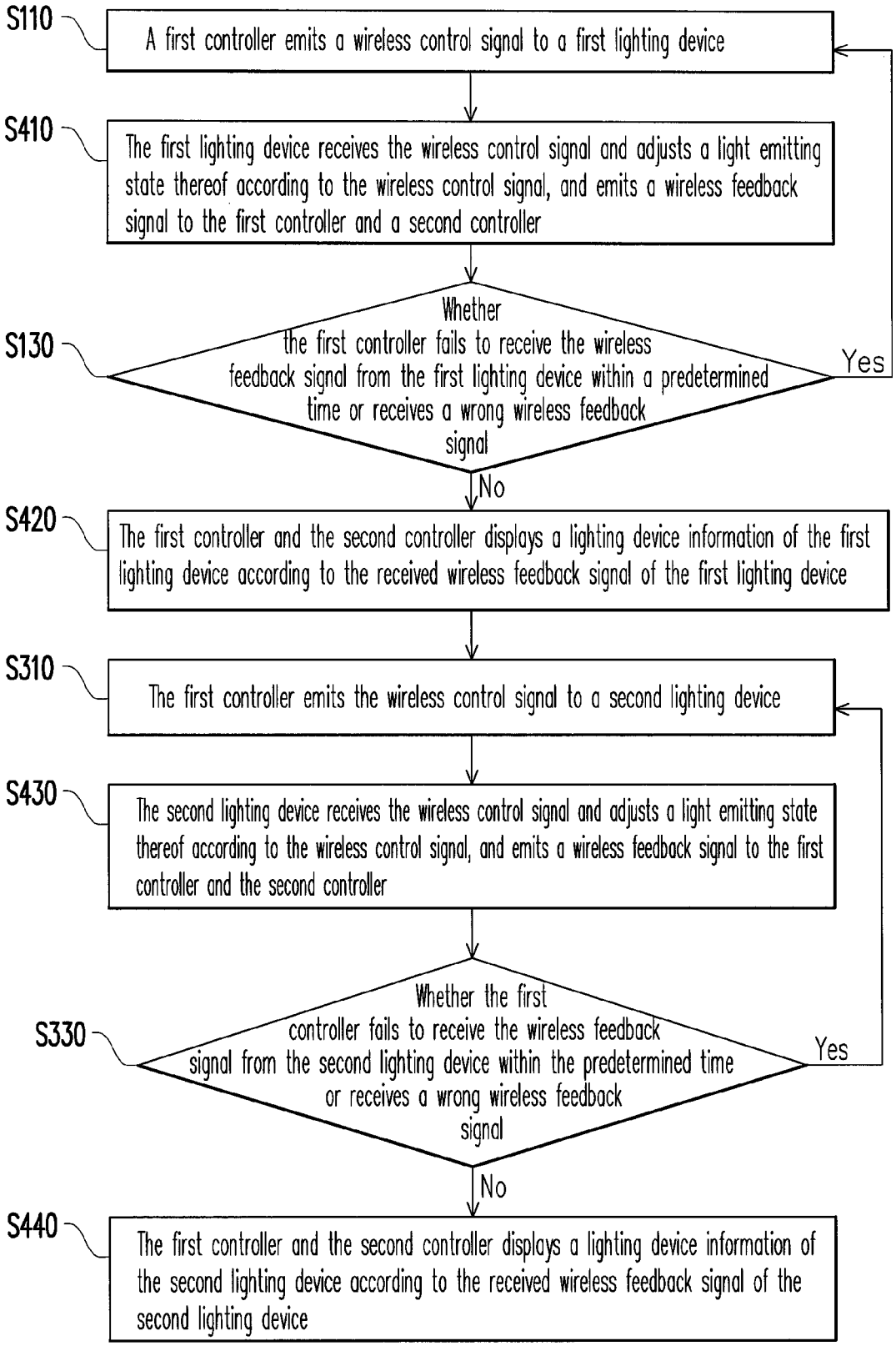
FIG. 4B is a flowchart of an operation method of the illumination system according to the fourth embodiment of the invention.

FIG. 4B is a flowchart of an operation method of the illumination system according to the fourth embodiment of the invention, and the operation method is exemplified by the first controller emitting the wireless control signal. Referring to FIGS. 3B and 4B, the differences therebetween are the Steps S410, S420, S430, and S440. In the Step S410, the first lighting device receives the wireless control signal and accordingly adjusts the light emitting state thereof, and the first lighting device accordingly emits the wireless feedback signal to the first and second controllers. In the Step 420, the first and second controllers display the lighting device information of the first lighting device according to the received wireless feedback signal of the first lighting device. In the Step S430, the second lighting device receives the wireless control signal and accordingly adjusts the light emitting state thereof, and the second lighting device accordingly emits the wireless feedback signal to the first and second controllers. In the Step 440, the first and second controllers display the lighting device information of the second lighting device according to the received wireless feedback signal of the second lighting device. Other steps in the operating method of the illumination system may refer to the description of the illumination system 400 provided above, and therefore further elaboration is omitted. Furthermore, the order of the aforementioned steps is merely for illustrative purposes, and thus the embodiments of the invention are not limited thereto. Moreover, the flowchart of the second controller 210 emits the wireless control signal to control the first lighting device 120, the first lighting device 120 emits the wireless feedback signal to the first and second controllers 110 and 210 according to this wireless control signal, the second controller 210 emits the wireless control signal to control the second lighting device 310, and the second lighting device 310 emits the wireless feedback signal to the first and second controllers 110 and 210 according to this wireless control signal is similar to FIG. 4B. Accordingly, further elaboration of the operation method depicted in FIG. 4B is omitted hereafter.

In one embodiment of the invention, the first lighting device 120 and the second lighting device 310 of the illumination system 400 may periodically provide wireless feedback signals (e.g., WF1-WF4) to the first and second controllers 110 and 210, so as to periodically update the lighting device information displayed by the first and second controllers 110 and 210. For example, the first lighting device 120 may periodically provide wireless feedback signals WF1 and WF2 respectively to the first and second controllers 110 and 210.

In view of the foregoing, according to the afore-described embodiments, after the first controller emits the wireless control signal to the first lighting device and/or the second lighting device and the corresponding wireless feedback signal is not received within a predetermined time, or a wrong wireless feedback signal is received, the same wireless control signal can be emitted again. Thereby, the first lighting device and/or the second lighting device can be properly adjusted according to the wireless control signal, and the first controller can accurately display the lighting device information of the first lighting device and/or the second lighting device. Moreover, the wireless feedback signals of the first lighting device and/or the second lighting device can be simultaneously transmitted to the second controller, so the lighting device information displayed by the first and second controllers is synchronized. When the transmission iterations of the wireless control signal reaches a predetermined number of times, the first controller can terminate emitting the wireless control signal and display an error message.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An illumination system, comprising:

a first controller for emitting a first wireless control signal; and a first lighting device for receiving the first wireless control signal, adjusting a first light emitting state of the first lighting device according to the first wireless control signal, and accordingly emitting a first wireless feedback signal;

wherein, the first controller emits the first wireless control signal to the first lighting device again when the first wireless feedback signal is not received within a predetermined time, or when a wrong wireless feedback signal is received after the first controller emits the first wireless control signal to the first lighting device, wherein the illumination system further comprises a second controller, and the second controller is configured to emit a second wireless control signal, the first lighting device is configured to receive the second wireless control signal, the first wireless control signal comprises a first controller identification code, and the second wireless control signal comprises a second controller identification code.

2. The illumination system as claimed in claim 1, wherein the first controller displays a first lighting device information of the first lighting device according to the received first wireless feedback signal.

3. The illumination system as claimed in claim 2, wherein the first lighting device is configured to emit a second wireless feedback signal to the second controller, and the second controller is configured to display the first lighting device information of the first lighting device according to the received second wireless feedback signal.

4. The illumination system as claimed in claim 3, wherein the first lighting device is configured to adjust a second light emitting state of the first lighting device according to the second wireless control signal, and when the first controller and the second controller respectively emits the first wireless control signal and the second wireless control signal to the first lighting device, the first lighting device adjusts the corresponding first light emitting state or the second light emitting state of the first lighting device according to the received first wireless control signal or the second wireless control signal.

5. The illumination system as claimed in claim 3, wherein the first wireless feedback signal comprises a first identification code, a second identification code, a control operation code, and the first lighting device information, wherein the first identification code of the first wireless feedback signal corresponds to an identification code of the first controller, the second identification code of the first wireless feedback signal is the same as the first identification code of the first wireless feedback signal, the second wireless feedback signal comprises a first identification code, a second identification code, the control operation code, and the first lighting device information, wherein the first identification code of the second wireless feedback signal corresponds to an identification code of the second controller, and the second identification code of the second wireless feedback signal corresponds to the identification code of the first controller.

6. The illumination system as claimed in claim 5, wherein the first wireless control signal comprises a target lighting device identification code and the control operation code.

7. The illumination system as claimed in claim 2, wherein the first controller comprises:

an input unit providing a user interface and configured to output an input signal;

a first wireless transceiver unit configured to emit the first wireless control signal and to receive the first wireless feedback signal;

a display unit configured to display the first lighting device information of the first lighting device; and a first control unit coupled to the input unit, the first wireless transceiver unit, and the display unit, and the first control unit controlling the first wireless transceiver unit to emit the first wireless control signal according to the input signal, and controlling the display of the display unit according to the first wireless feedback signal.

8. The illumination system as claimed in claim 7, wherein the first lighting device comprises:

an illumination unit;

a driving unit coupled to the illumination unit, and the driving unit configured to drive the illumination unit;

a second wireless transceiver unit configured to receive the first wireless control signal and to emit the first wireless feedback signal; and a second control unit coupled to the driving unit and the second wireless transceiver unit, and, the second control unit adjusts at least one of a luminance, an illuminating color tone, and an illuminating operating mode of the illumination unit through the driving unit according to the first wireless control signal, and the second control unit emits the first wireless feedback signal through the second wireless transceiver unit.

9. The illumination system as claimed in claim 3, wherein the first lighting device is configured to periodically emit the first wireless feedback signal to the first controller, and to periodically emit the second wireless feedback signal to the second controller.

10. The illumination system as claimed in claim 2, wherein the first lighting device information of the first lighting device comprises a first lighting device identification code and a first lighting device luminance.

11. The illumination system as claimed in claim 10, wherein the first lighting device information further comprises an illuminating color tone or an illuminating operating mode.

12. The illumination system as claimed in claim 1, further comprising a second lighting device, the first controller configured to emit a third wireless control signal to the second lighting device, and the second lighting device configured to receive the third wireless control signal, adjust a first light emitting state of the second lighting device according to the third wireless control signal, and accordingly emit a third wireless feedback signal to the first controller.

13. The illumination system as claimed in claim 12, wherein the first controller emits the third wireless control signal to the second lighting device again when the third wireless feedback signal is not received within the predetermined time, or when the wrong wireless feedback signal is received after the first controller emits the third wireless control signal to the second lighting device.

14. The illumination system as claimed in claim 12, wherein the first controller displays a first lighting device information of the second lighting device according to the received third wireless feedback signal of the second lighting device.

15. The illumination system as claimed in claim 14, further comprising a second controller, wherein the first lighting device is configured to emit a second wireless feedback signal to the second controller, and the second controller is configured to display a first lighting device information of the first lighting device according to the received second wireless feedback signal.

16. The illumination system as claimed in claim 15, wherein the second controller is configured to emit a fourth wireless control signal to the second lighting device, and the second lighting device is configured to receive the fourth wireless control signal, adjust a second light emitting state of the second lighting device according to the fourth wireless control signal, and accordingly emit a fourth wireless feedback signal, wherein the second controller emits the fourth wireless control signal to the second lighting device again when the fourth wireless feedback signal is not received within the predetermined time, or when the wrong wireless feedback signal is received after the second controller emits the fourth wireless control signal to the second lighting device.

17. The illumination system as claimed in claim 16, wherein the second controller displays a second lighting device information of the second lighting device according to the received fourth wireless feedback signal.

18. The illumination system as claimed in claim 1, wherein the first controller displays an error message when the first wireless feedback signal is not received, or when the wrong wireless feedback signal is received after the first controller emits the first wireless control signal a predetermined number of times.

19. An operation method of an illumination system, wherein the illumination system comprises a first controller and a first lighting device, the operation method of the illumination system comprising:

emitting a first wireless control signal to the first lighting device with the first controller;

receiving the first wireless control signal, adjusting a first light emitting state of the first lighting device according to the first wireless control signal, and accordingly emitting a first wireless feedback signal to the first controller with the first lighting device; and when the first controller has not received the first wireless feedback signal within a predetermined time, or has received a wrong wireless feedback signal, emitting the first wireless control signal to the first lighting device again with the first controller, wherein the illumination system further comprises a second controller, and the second controller is configured to emit a second wireless control signal, the first lighting device is configured to receive the second wireless control signal, the first wireless control signal comprises a first controller identification code, and the second wireless control signal comprises a second controller identification code.

20. The operation method of the illumination system as claimed in claim 19, further comprising:

when the first controller receives the first wireless feedback signal, displaying a first lighting device information of the first lighting device with the first controller according to the received first wireless feedback signal.

21. The operation method of the illumination system as claimed in claim 20, the operation method of the illumination system further comprising:

emitting a second wireless feedback signal to the second controller with the first lighting device; and when the second controller receives the second wireless feedback signal, displaying the first lighting device information of the first lighting device with the second controller according to the received second wireless feedback signal.

22. The operation method of the illumination system as claimed in claim 21, wherein the first lighting device is configured to adjust a second light emitting state of the first lighting device according to the second wireless control signal, the operation method of the illumination system further comprising:

respectively emitting the first wireless control signal and the second wireless control signal to the first lighting device with the first controller and the second controller; and adjusting the corresponding first light emitting state or the second light emitting state of the first lighting device according to the received first wireless control signal or the second wireless control signal with the first lighting device.

23. The operation method of the illumination system as claimed in claim 21, further comprising:

with the first lighting device, periodically emitting the first wireless feedback signal to the first controller, and periodically emitting the second wireless feedback signal to the second controller.

24. The operation method of the illumination system as claimed in claim 19, the illumination system further comprising a second lighting device, the operation method of the illumination system further comprising:

with the first controller, emitting a third wireless control signal to the second lighting device;

with the second lighting device, receiving the third wireless control signal, adjusting a first light emitting state of the second lighting device according to the third wireless control signal, and accordingly emitting a third wireless feedback signal to the first controller; and when the first controller has not received the third wireless feedback signal within the predetermined time, or when the first controller has received the wrong wireless feedback signal, emitting the third wireless control signal to the second lighting device again with the first controller.

25. The operation method of the illumination system as claimed in claim 24, further comprising:

when the first controller receives the third wireless feedback signal, displaying a first lighting device information of the second lighting device with the first controller according to the received third wireless feedback signal.

26. The operation method of the illumination system as claimed in claim 24, the illumination system further comprising a second controller configured to emit a fourth wireless control signal, the operation method of the illumination system further comprising:

emitting a second wireless feedback signal to the second controller with the first lighting device;

displaying the first lighting device information of the first lighting device according to the received second wireless feedback signal with the second controller;

receiving the fourth wireless control signal, adjusting a second light emitting state of the second lighting device according to the fourth wireless control signal, and accordingly emitting a fourth wireless feedback signal to the second controller with the second lighting device; and displaying a second lighting device information of the second lighting device according to the received fourth wireless feedback signal with the second controller.

27. The operation method of the illumination system as claimed in claim 19, further comprising:

displaying an error message with the first controller when the first wireless feedback signal is not received, or when the wrong wireless feedback signal is received, after the first controller emits the first wireless control signal a predetermined number of times.

* * * * *